US007040783B1

(12) United States Patent
Christianson

(10) Patent No.: US 7,040,783 B1
(45) Date of Patent: May 9, 2006

(54) ADJUSTABLE CLAMP-ON LAMP WITH BALL-HEAD

(75) Inventor: Thomas R. Christianson, Napa, CA (US)

(73) Assignee: ShowerTek, Inc., Napa, CA (US)

( * ) Notice: Subject to any disclaimer, the term of this patent is extended or adjusted under 35 U.S.C. 154(b) by 200 days.

(21) Appl. No.: 10/823,165

(22) Filed: Apr. 12, 2004

(51) Int. Cl.
*F21V 21/088* (2006.01)
*F21V 21/30* (2006.01)

(52) U.S. Cl. ..... 362/396; 362/186; 362/250; 362/363; 362/421; 362/427; 362/430

(58) Field of Classification Search ..... 362/98–99, 362/186, 190–191, 227, 232, 234–235, 249–251, 362/253, 269, 285, 296, 341, 363, 396, 565, 362/806, 808–809, 421, 427, 430
See application file for complete search history.

(56) References Cited

U.S. PATENT DOCUMENTS 5,388,825 A * 2/1995 Myers et al. ..... 473/570
6,076,946 A * 6/2000 Brouillette et al. ..... 362/362
6,155,700 A * 12/2000 Hsu ..... 362/363
6,224,230 B1 * 5/2001 Roegiers ..... 362/123
6,626,554 B1 * 9/2003 Rincover et al. ..... 362/186
D496,483 S * 9/2004 Christianson ..... D26/60

* cited by examiner

*Primary Examiner*—Alan Cariaso
*Assistant Examiner*—Jason Han
(74) *Attorney, Agent, or Firm*—David Pressman

(57) ABSTRACT

A clip-on task lamp has a ball-shaped head that is pivotally and frictionally mounted between the cup-shaped ends of two tines of a ball-holding fork so that the ball-head can be rotated to any position. The ball-head has a front lens with two LEDs that are backed by a reflector. The ball has a flexible two-state pushbutton switch on the rear side and an internal battery. The base of the ball-holding fork comprises a single leg with a small swivel ball. The lamp has a clamp part that has, at its top end, two arms with two respective cup ends that hold the small swivel ball by friction fit. The base end of the clamp part comprises two legs, a shorter one of which is springably pivoted on an ear of the other. The end of each leg has a swivel pad and the shorter leg has a projection for facilitating spreading the legs so that they can be sandwiched around a member and clamped to it.

13 Claims, 8 Drawing Sheets

ADJUSTABLE CLAMP-ON LAMP WITH BALL-HEAD

BACKGROUND

1. Field of Invention

This invention relates generally to lamps, specifically to a clamp-on lamp which can swivel and pivot to a wide range of positions.

2. Prior Art

Heretofore portable clamp-on lamps were large and unwieldy and could not be adjusted to shine light in a relatively wide range of areas. E.g., existing clamp on lamps were too large to fit on mirrors for use in a shower and were not versatile, i.e., they could not be positioned so that they illuminated the mirror or the user, such as a man shaving. (One such mirror is shown in my patent U.S. Pat. No. 5,953,157 (1999).) Also existing clamp-on lamps were too heavy to clamp onto such a mirror, they were awkward to use, were not waterproof, and/or required mains electrical power, which was dangerous and unwieldy for a shower.

OBJECTS AND ADVANTAGES

Accordingly, several advantages of some aspects of the invention are to provide an improved clamp-on lamp that can be adjusted to shine light in a relatively wide range of areas, that can be used with a shower mirror in a convenient and facile way to provide additional light for the user of the mirror for shaving, grooming, etc., that is small enough to fit on such mirrors, that are versatile so as to be able to swivel to useful positions where they can illuminate the mirror or the user, that are light enough to clamp onto the mirror, they are easy to use, and are waterproof. Other advantages of various aspects of the invention will become apparent from a consideration of the ensuing description and the accompanying drawings.

SUMMARY

In accordance with the invention, a clip-on task lamp has a spherical- or ball-shaped head that is pivotally and frictionally mounted between the cup-shaped ends of two tines of a ball-holding fork so that the ball-head can be rotated to any position. The ball-head has a front lens with two LEDs that are backed by a reflector. The ball has a flexible two-state pushbutton switch on the rear side and an internal battery. The base of the ball-holding fork comprises a single leg with a small swivel ball. The lamp has a clamp part that has, at its top end, two arms with two respective cup ends that hold the small swivel ball by friction fit. The base end of the clamp part comprises two legs, a shorter one of which is springably pivoted on an ear of the other. The end of each leg has a swivel pad and the shorter leg has a projection for facilitating spreading the legs so that they can be sandwiched around a member and clamped to it.

DRAWINGS—FIGURES

DRAWINGS—REFERENCE NUMERALS

| | | | |
|---|---|---|---|
| 10 | ball head | 10B | contact button |
| 10C | cylindrical ridge | 10D | LED |
| 10F | front part | 10I | inside ridge |
| 10L | lens | 10N | radial notches |
| 10P | contact strap | 10R | reflector |
| 10S | switch cover | 12 | holding clamp |
| 12C | curved leg | 12E | pivot mount |
| 12L | lug or spur | 12M | main leg |
| 12P | pivotable pad | 12V | pivot pin |
| 14 | ball-holding fork | 14B | small ball |
| 14L | leg | 16 | mirror |

DETAILED DESCRIPTION—PREFERRED EMBODIMENT—FIGS. 1 TO 7

Figure 1:
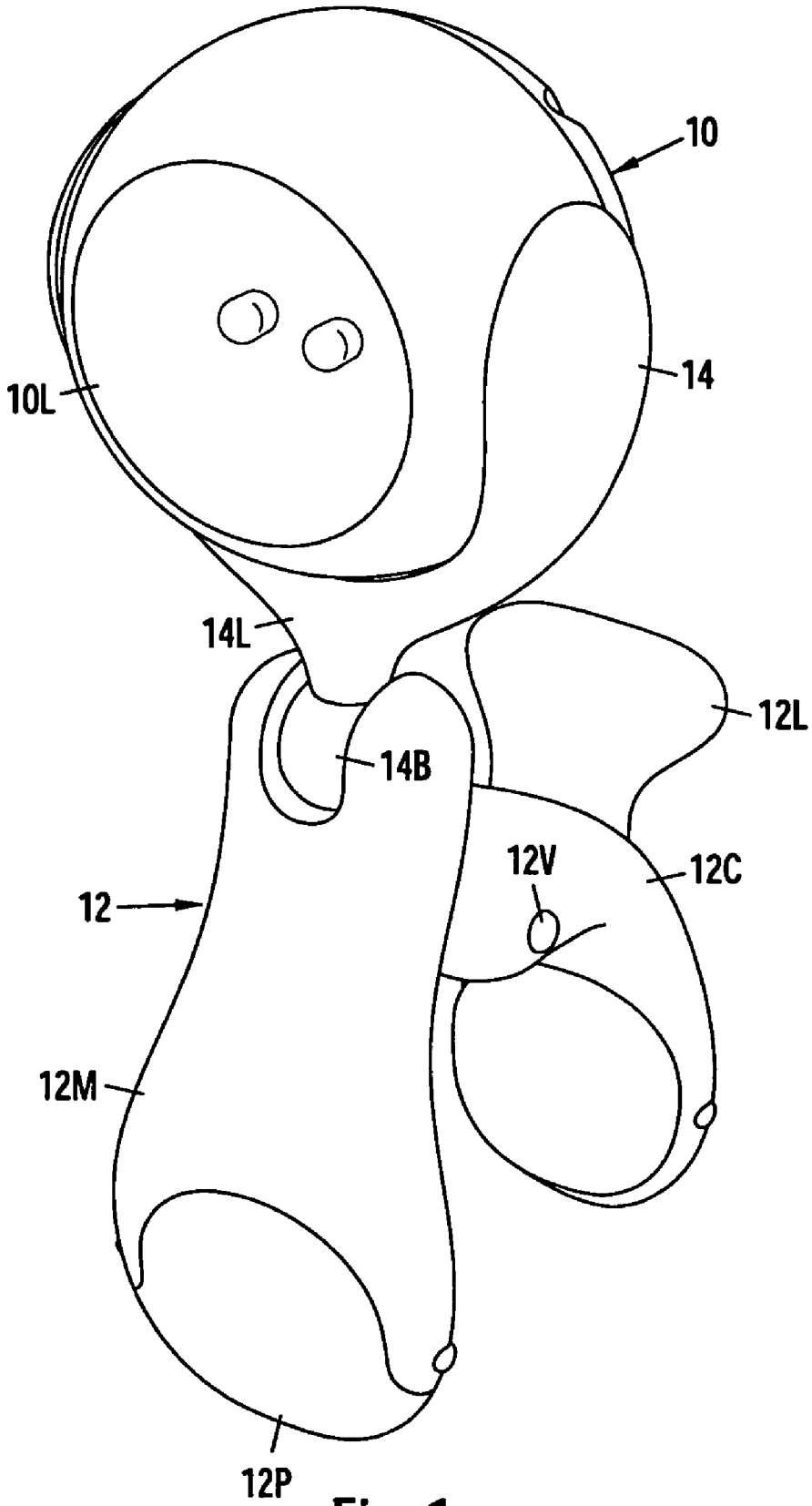
FIG. 1 is a perspective view taken from the front and above of a clip-on lamp including a ball head and a holding clamp according to the invention.

FIG. 1 is a perspective view taken from the front and above of my clip-on lamp. It has a ball or spherical head 10 at its upper end and a holding clamp 12 at its base. Ball head 10 is pivotably, springably, and frictionally mounted between the tines of a ball-holding fork 14 that forms the upper end of clamp 12. The ends of the tines have cupped or concave inner sides (FIG. 7) that conformingly mate with the concave surface of the ball head. The tines of the fork meet at a base that has a single leg 14L (FIG. 1) that extends down from the tines and has a small ball 14B at its lowermost end that permits the fork to swivel.

The bottom part of holding clamp 12 comprises a clip that has two legs, a main or generally straight leg 12M and a pivotable curved leg 12C that is pivoted on main leg 12M. The pivot of leg 12C contains a spring that urges leg 12C against leg 12M, but the legs are shown spread apart for better illustration. The end of each leg has a pivotable pad 12P. Curved leg 12C has a projecting ear, lug, or thumb spur 12L that facilitates opening the legs.

Figure 2:
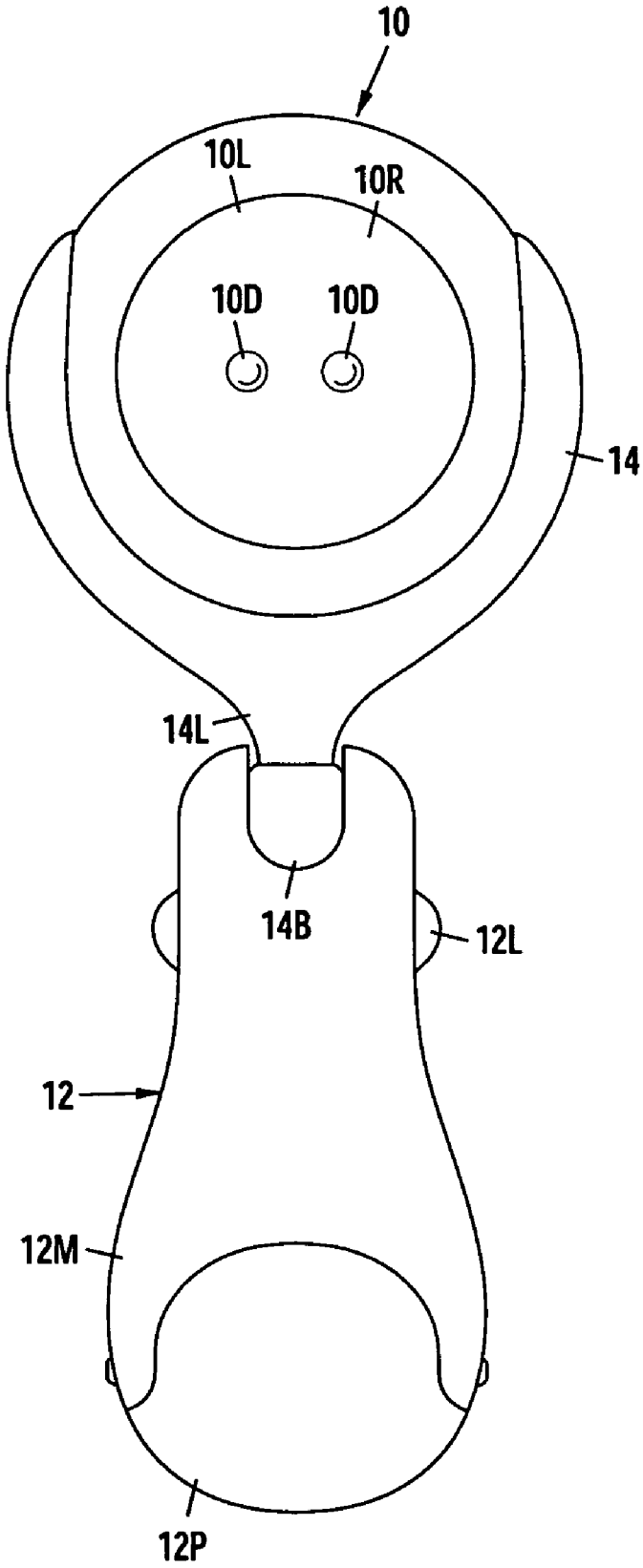
FIG. 2 is a front elevational view of the clip-on lamp.

As shown in FIG. 1 and the front elevational view of FIG. 2, the front end of ball head 10 has a clear lens or lamp portion 10L that is continuous with and forms a front part of the spherical surface of the ball. Inside the lens are two light-emitting elements, preferably LEDs (light-emitting diodes) 10D that are backed by a curved reflector 10R.

Figure 3:
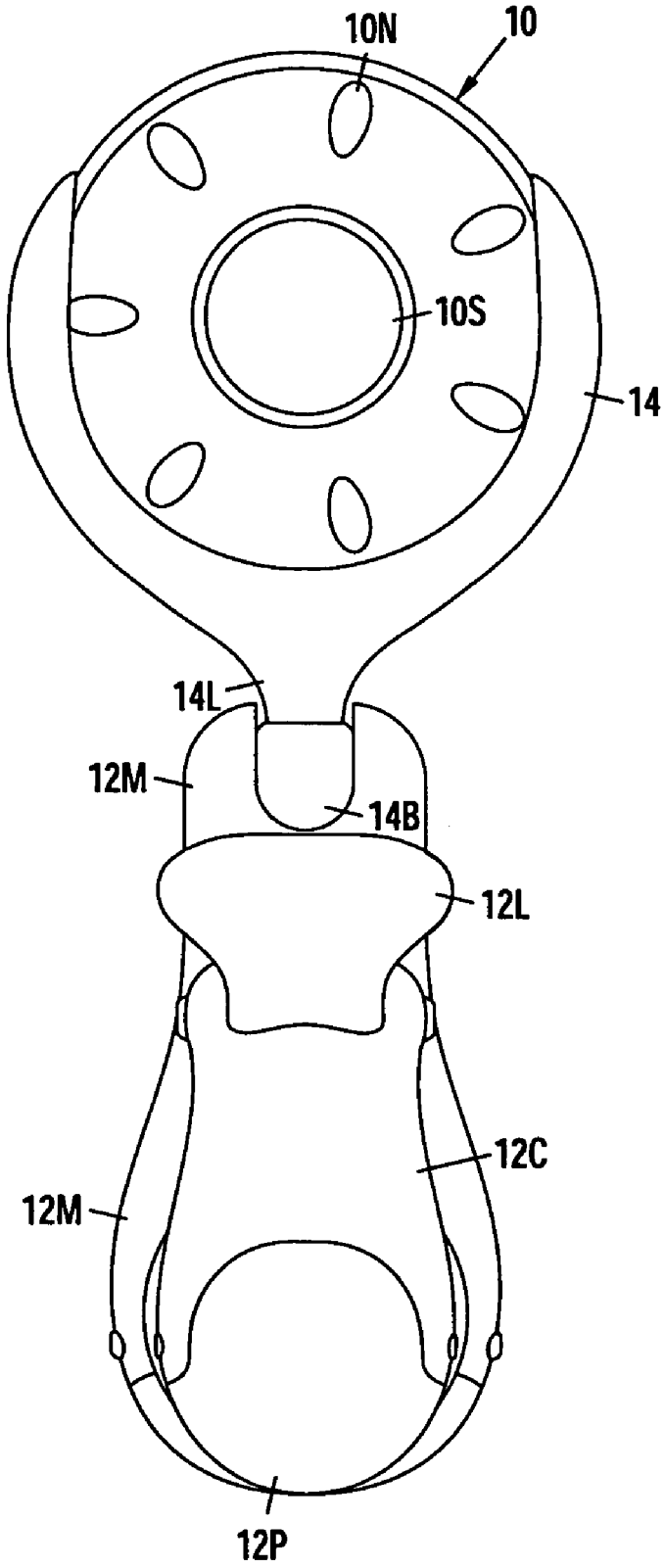
FIG. 3 is a rear elevational view of the clip-on lamp.
Figure 4:
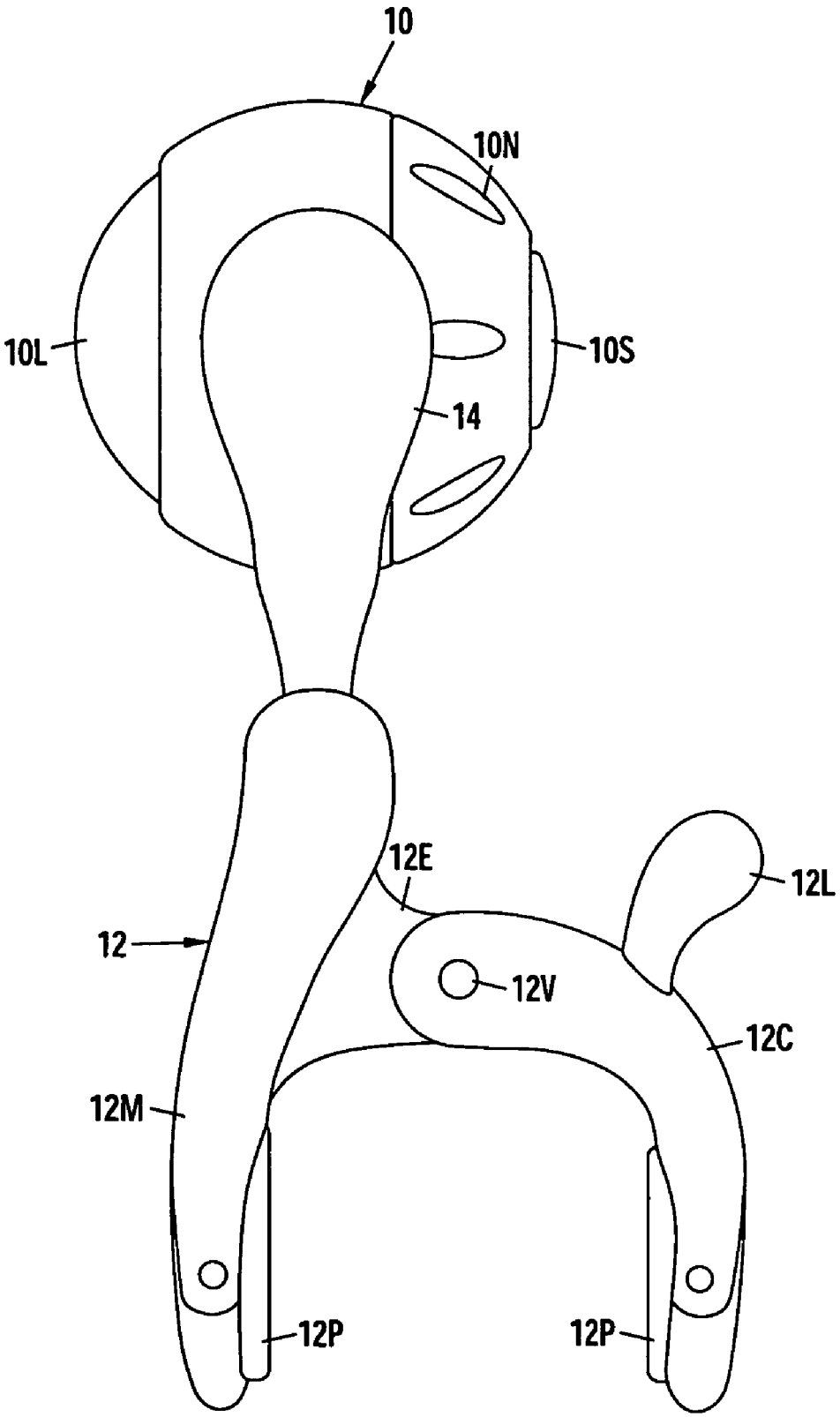
FIG. 4 is an elevational view of the right side of the clip-on lamp showing its holding clamp in an open condition. The left side of the lamp is a mirror image of the right side.

The rear elevational view of FIG. 3 best shows the tines of ball-holding fork 14. They have a generally U-shape and are spaced so as to grip ball head 10 tightly enough to hold it securely in any position while still allowing a user to adjust it. The rear end or back of ball head 10 has a series of radial notches ION to facilitate unscrewing the back, as will be discussed. Inside the ball head is a two-state pushbutton switch (not shown) that is covered by a waterproof flexible membrane, switch cover, or pushbutton switch portion 110S of rubber or vinyl. Switch cover 110S is continuous with and forms a rear part of the spherical surface of the ball. Main leg 12M of clamp 12, as shown in FIG. 4, a side elevational view, has a lug or pivot mount 12E extending out from its side. Curved leg 12C is pivotably attached to mount 12E by a pivot pin 12V which has a spring (not shown)

mounted on it to urge curved leg 12C against main leg 12M. (The legs are shows spread in FIG. 4.) Curved leg 12C has a generally right angle bend and lug 12L extends out from the outside of the bend area. Each pad 12P is shown as having two layers, but each pad can have a single layer.

Figure 5:
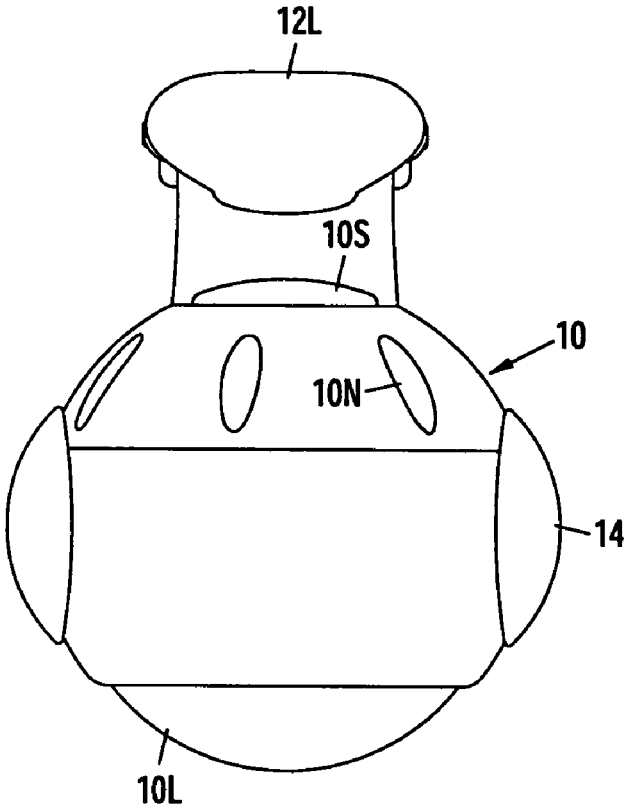
FIG. 5 is a top view of the clip-on lamp.
Figure 6:
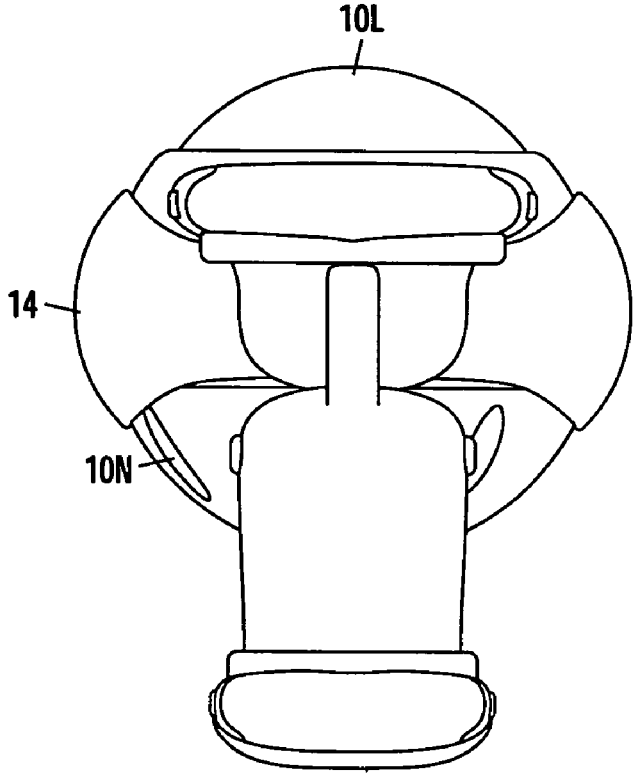
FIG. 6 is a bottom view of the clip-on lamp.

Further details of the lamp can be seen in the top and bottom views of FIGS. 5 and 6.

Figure 7:
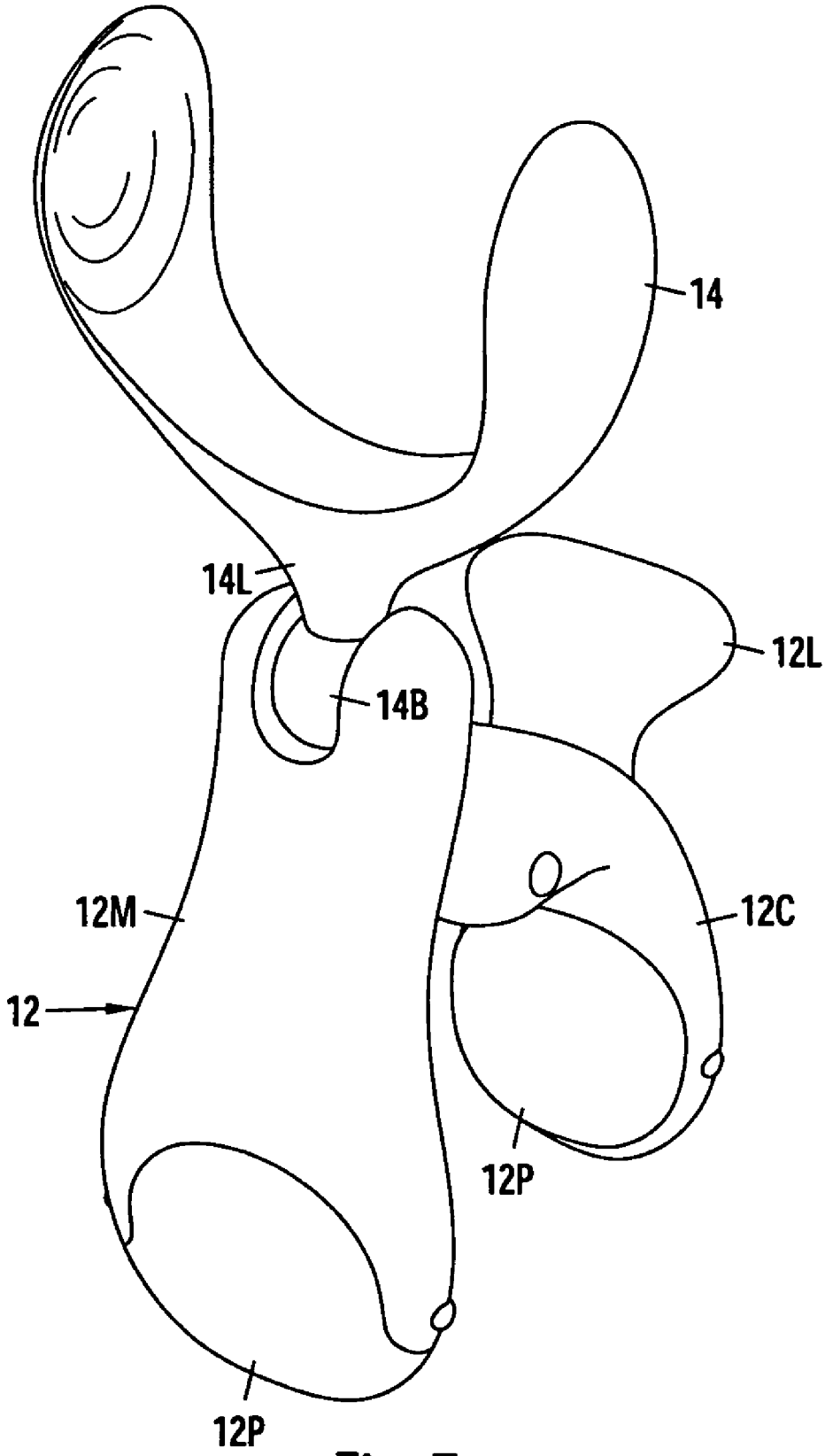
FIG. 7 is a perspective view of the holding clamp.

Clamp 12 is shown in FIG. 7 in an open position without the ball head. Note that the upper ends of the tines have concave inner sides.

In one embodiment, ball head 10 had a diameter of about 38 mm and the overall lamp had a length of 115 mm, with parts sized proportionally. All parts were made of rigid plastic, with membrane 10S and pads 12P being made of flexible vinyl or rubber and pivot pin 12V and its spring (not shown) being made of stainless steel. Except for tens 10L, which is transparent, the ball was made of grey plastic. The fork and the clamp were made of transparent plastic and pads 12P were grey. Inside ball head 10, the switch parts, the LEDs, and the wiring were made of conventional materials.

Figure 8:
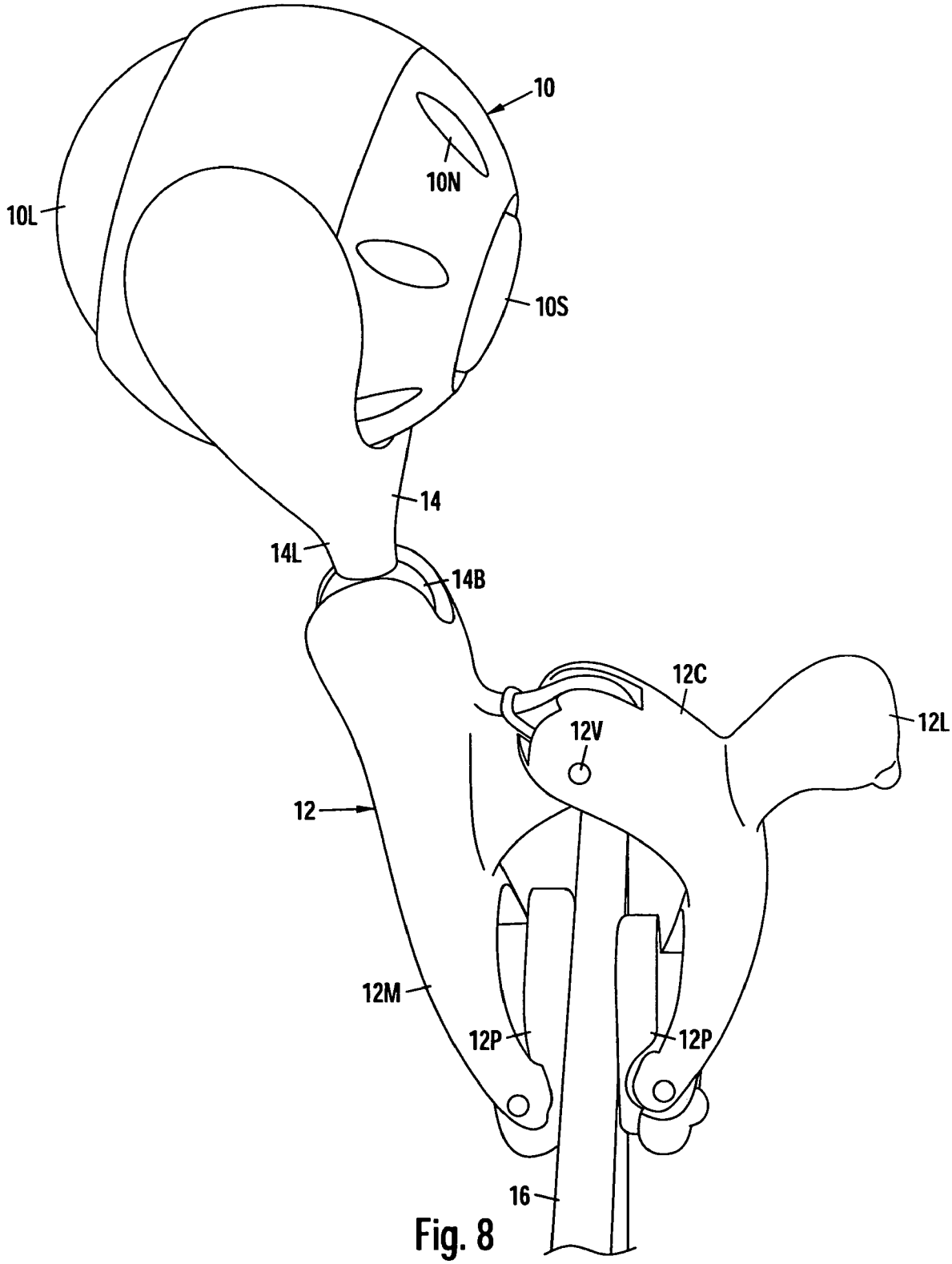
FIG. 8 is a perspective view of the clip-on lamp attached to an object.

Operation—FIG. 8

To operate and use the lamp, the user first clamps its main and curved legs 12M and 12C (FIG. 8) around a suitable mount near the area to be illuminated. E.g., assume that the lamp is to be used in a shower environment to illuminate the face of a user who is shaving with the aid of a fog-free shower mirror 16. The user first opens or spreads the main and curved legs of the clamp apart. This operation can usually be done with one hand with the aid of lug 12L by holding ball head 10 with the fingers and using the thumb to spread the legs. The user then places the legs around the edge or frame of the mirror and releases the thumb pressure on the lug so that the spring around pivot pin 12V forces the legs closed so that pads 12P grip the edge of the mirror as indicated. Due to the force of the grip from the spring and the friction of the pads, the clamp will hold the mirror securely in any position.

Next the user turns on the lamp by depressing switch cover 10S and adjusts the angle of the ball head and pivot ball 14B so that the light from the front of the lamp, emitted through lens 10L, shines on the user's face. Due to the friction grip on both of these balls, the ball head will remain in any position to which it is adjusted. If the user changes the position of the mirror, the lamp will remain in the same position with respect to the mirror, but its position can easily be readjusted if necessary. When the user is finished shaving, they will turn the lamp off by re-pressing membrane 10S. If the user desires to illuminate any other task, they can easily remove the lamp and reattach it to any mount that is close to the task. E.g., for reading a book, the lamp can be clamped to the cover of a book and made to shine on the pages, for working on an electrical or mechanical device, the lamp can be clamped to any convenient mount, such as the leg of a conventional lamp, a bookcase, a rib on the underside of a car hood, etc. Since the lamp has no wires and is small and light, it can be conveniently used safely anywhere. Since it uses LEDs, its batteries will have a very long life, yet it will provide ample light for fine visual tasks. Since its head is self-contained and waterproof, it can be used in wet environments The ball head resembles an eye and can be used alone, without its clamp-holder, e.g., as a lit throwing and catching ball or as a very compact flashlight. It can be removed from and replaced in fork 14 by simply pulling it out or pushing it back between the tines.

Figure 9:
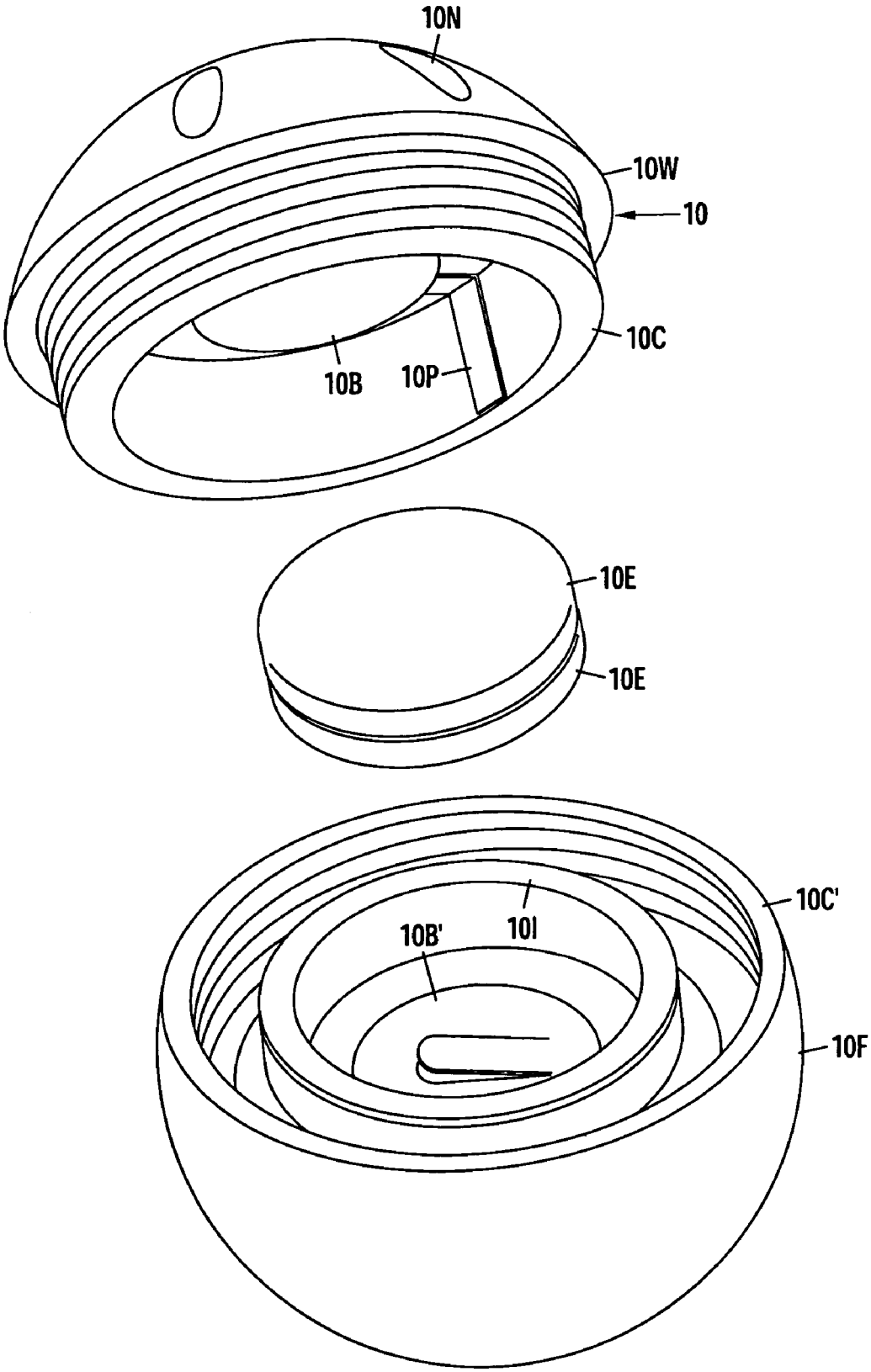
FIG. 9 is an exploded view of the ball-head showing the back (switch part), an energy cell, and the front (bulb part).

FIG. 9—Ball Head Details

FIG. 9 is an exploded view of ball-head 10 showing its back or switch part 10W, its energy cells 10E, and its front or bulb part 10F. In the embodiment presently used, two energy cells similar to cell 10E are used in series, but one or more than two can be used. Currently the lamp uses two type CR2032 lithium cells, whose output is 3 volts each.

Switch or back part 10W has a partially spherical back that forms part (about ⅓) of the sphere or ball shape of the head. Inside the back part is a conventional two-state, push-on-push-off switch (not shown). Extending out from the back part and spaced in from the outside is a cylindrical ridge, flange, or collar 10C that has screw threads on its outside surface. A conventional contact button 10B is positioned in the center of the back part and a conventional lead or strap 10P extends up to mate with a contact in bulb part 10B as in a conventional flashlight circuit.

Front or bulb part 10F also has a partially spherical shape that forms the remaining part (about ⅔) of the sphere or ball shape of the head. Extending out from the front part is a cylindrical collar 10C' that has screw threads on its inside surface that mate with the threads on cylinder 10C of the back part. Also extending out from the front part is an internal or inside cylindrical or circular collar 10I that is concentric with collar 10C' and forms a cylindrical groove or moat between the two collars. The internal diameter of internal collar 10I is 20 mm, which is slightly larger than the diameter of energy cell 10E. In the center of collar 10I is a front contact button 10B' that has a partially upstanding tang. The outside of collar 10I has a contact ring that mates with strap 10P. The contact ring also communicates with one terminal of the LEDs and the other terminal is connected to contact button 10B'.

When the two portions of the head are mated, the energy cells are placed inside ridge 10I and the two portions are brought together and aligned and rotated to mate the threads of collar 10C with those of collar 10C'. As the parts are screwed together, collar 10C extends into the moat or cylindrical space between collars 10I and 10C' and button 10B. As the parts are screwed home, the cells are compressed slightly between buttons 10B and 10B', so as to force down the tang of button 10B'. Cells 10E are also held within or prevented from sidewise travel by collar 10I. A conventional gasket (not shown) is used around ridge 10C to prevent water from entering the lamp.

CONCLUSION, RAMIFICATIONS, AND SCOPE

Accordingly the reader will see that, according to the invention, I have provided an improved clamp-on lamp that can be adjusted to shine light in a relatively wide range of areas, that can be used with a shower mirror in a convenient and facile way to provide additional light for the user of the mirror for shaving, grooming, etc., that is small enough to fit on such mirrors, that is versatile so as to be able to swivel to useful positions where it can illuminate the mirror or the user, that is light enough to clamp onto the mirror, that is easy to use, is waterproof, and does not require mains power.

While the above description contains many specifics, these should not be construed as limitations on the scope of the invention, but as exemplifications of the presently preferred embodiments thereof. Many other ramifications and variations are possible within the teachings of the invention.

For example the lamp head can have a shape other than spherical, such as oval, rectangular, etc. The head may be held by a pivot pin rather than a friction mount. The shape of the head-holding fork arms can change, as can the shape of the clamp arms. Both arms can be straight or curved and of similar shape. The lug on the curved arm can be eliminated. The pads on the arms can be changed or eliminated. The ball-and-socket joint at the base of the head holding fork can be changed to a flexible arm or can be made rigid. The type of bulbs in the head can be changed to incandescent or fluorescent. The internal arrangement of the ball head can be changed. The switch can be a rotational switch, a slide switch, etc.

Thus the scope of the invention should be determined by the appended claims and their legal equivalents, and not by the examples given.

The invention claimed is:

1. A lamp, comprising:

a spherical body having a front side containing a light portion and a rear side containing a pushbutton switch portion, the outside of said spherical body comprising a substantially entirely spherical surface, said light portion having a partially spherical surface that forms a continuous part of said spherical surface of said spherical body, said pushbutton switch portion also having a partially spherical surface that forms another continuous part of said spherical surface of said spherical body, whereby said lamp, when held by a clamp, can be oriented in any position, and further including a clamp having a pair of opposite ends with a fork at one end and a clip at the opposite end, said fork comprising a pair of arms shaped to hold said spherical body by friction fit so as to enable sad spherical body to rotate in said arms and be held in any position by friction fit.

2. The lamp of claim 1 wherein said clip has a pair of legs that are springably urged together so that said clip can be used to attach said lamp to a support.

3. The lamp of claim 1 wherein said arms of said fork are joined at a base that comprises a pivot ball and said clip comprises a pair of legs that are joined at an apex that comprises a socket that mates frictionally with said pivot ball.

4. A lamp, comprising:

a spherical body having a front side containing a light portion and a rear side containing a pushbutton switch portion, the outside of said spherical body comprising a substantially entirely spherical surface, said light portion having a partially spherical surface that forms a continuous part of said spherical surface of said spherical body, said pushbutton switch portion also having a partially spherical surface that forms another continuous part of said spherical surface of said spherical body, whereby said lamp, when held by a clamp, can be oriented in any position, and further including a clamp having a pair of opposite ends with a fork at one end and a clip at the opposite end, said fork comprising a pair of arms shaped to hold said spherical body by friction fit so as to enable said spherical body to rotate in said arms and be held in any position by friction fit, said clip having a pair of legs that are springably urged together so that said clip can be used to attach said lamp to a support, said fork arms being joined at a base that comprises a pivot ball and said clip legs being joined at an apex that comprises a socket that mates frictionally with said pivot ball.

5. The lamp of claim 4 wherein one of said legs of said pair of legs of said clip is substantially straight and has a projecting pivot mount, the other of said legs of said pair being pivotably and springably pivoted on said projecting pivot mount.

6. The lamp of claim 5 wherein each of said legs of said pair of legs has a free distal end which has a clamping pad mounted thereon.

7. The lamp of claim 6 wherein each of said clamping pads is pivotably mounted.

8. A lamp, comprising:

a spherical body, the outside of said body comprising a substantially complete spherical surface, said spherical body having a front side containing a light that forms a first portion of said spherical surface and a rear side containing a pushbutton switch that forms a second portion of said spherical surface, said first portion of said partially spherical surface having a partially spherical shape that forms a continuous part of said spherical surface of said spherical body, said second portion of said partially spherical surface having a partially spherical shape that forms another continuous part of said spherical surface of said spherical body, and a clamp having a pair of opposite ends with a fork at one end and a clip at the opposite end, said fork comprising a pair of arms with a concave portion on each arm shaped to hold said spherical body by friction fit so as to enable said spherical body to rotate in said arms and be held in any position by friction fit.

9. The lamp of claim 8 wherein said light comprises a transparent window and at least one light-emitting element inside said window.

10. The lamp of claim 8 wherein said pushbutton switch comprises a flexible covering membrane and a switch mechanism inside said membrane.

11. The lamp of claim 8 wherein said clip has a pair of legs that are springably urged together so that said clip can be used to attach said lamp to a support.

12. The lamp of claim 8 wherein said pair of arms of said fork are joined at a base that comprises a pivot ball and said clip has a pair of legs that are joined at an apex that comprises a socket that mates frictionally with said pivot ball.

13. The lamp of claim 12 wherein each of said legs of said pair of legs of said clip has a free distal end opposite said apex, said distal end of each leg having a clamping pad thereat.

* * * * *